United States Patent [19]

Yamaki et al.

[11] 4,013,056

[45] Mar. 22, 1977

[54] AUTOMATIC CONTROL SYSTEM FOR A GASOLINE-POWERED COMBUSTION ENGINE

[75] Inventors: Yasuhito Yamaki, Tokyo; Kunio Aiage, Gyoda, both of Japan

[73] Assignee: Fuji Jukogyo Kabushiki Kaisha, Tokyo, Japan

[22] Filed: Dec. 30, 1974

[21] Appl. No.: 537,432

[52] U.S. Cl. ..... 123/179 BG; 290/38 R; 62/229

[51] Int. Cl.[2] ..... F02N 17/00

[58] Field of Search ..... 123/179 B, 179 BG; 290/38

[56] References Cited

UNITED STATES PATENTS

| | | | |
|---|---|---|---|
| 2,691,110 | 10/1954 | Lincoln | 123/179 BG |
| 3,172,400 | 3/1965 | Hale | 123/179 BG |
| 3,248,555 | 4/1966 | Fried | 123/179 B |
| 3,259,753 | 7/1966 | McWhirter | 123/179 B |
| 3,415,999 | 12/1968 | Noury | 123/179 B |
| 3,538,898 | 11/1970 | Edgemir | 123/179 BG |
| 3,712,283 | 1/1973 | Kless et al. | 123/179 B |
| 3,757,756 | 9/1973 | Owyoung et al. | 123/179 B |
| 3,859,540 | 1/1975 | Weiner | 123/179 BG |
| 3,886,920 | 6/1975 | Van Dusen | 123/179 BG |

*Primary Examiner*—Charles J. Myhre
*Assistant Examiner*—Ronald B. Cox
*Attorney, Agent, or Firm*—Martin A. Farber

[57] ABSTRACT

An automatic control system for a gasoline-powered internal combustion engine of a load device, in which a switching unit is responsive to an input signal produced in response to a given operating condition of the load device and generates an operating signal by which an ignition coil is energized. A first driving unit is responsive to the operating signal and generates an output signal by which a starter device is energized. The first driving unit is also responsive to a speed discriminator signal generated by a speed sensing unit when the engine speed reaches a predetermined value and generates no output so that the starter device is de-energized when the engine speed reaches the predetermined value. A second driving unit is also responsive to the operating signal from the switching unit and generates an output signal for a predetermined time interval so that a throttle valve of an engine carburetor is closed for the predetermined time interval determined by the output signal from the second driving unit. In the absence of the output signal from the second driving unit, the throttle valve is opened to a predetermined degree of opening, whereby the engine is allowed to continuously operate.

9 Claims, 2 Drawing Figures

AUTOMATIC CONTROL SYSTEM FOR A GASOLINE-POWERED COMBUSTION ENGINE

DETAILED DESCRIPTION OF THE INVENTION

The present invention relates to an automatic control system for an internal combustion engine, and more particularly to an automatic control system for automatically controlling the operation of a gasoline-powered internal combustion engine of a load device, such as a freezing unit mounted on a refrigerator car.

For portable or installed gasoline powered internal combustion engines used for driving load devices such as a freezing unit, an automatic control system for readily and surely controlling the operation of the engine in close relationship to varying operating conditions of the load device has been required.

An object of the present invention is to provide an automatic control system for a gasoline-powered internal combustion engine of a load device, which system is arranged to automatically control the operation of the engine in close relationship to varying operating conditions of the load device.

Figure 1:
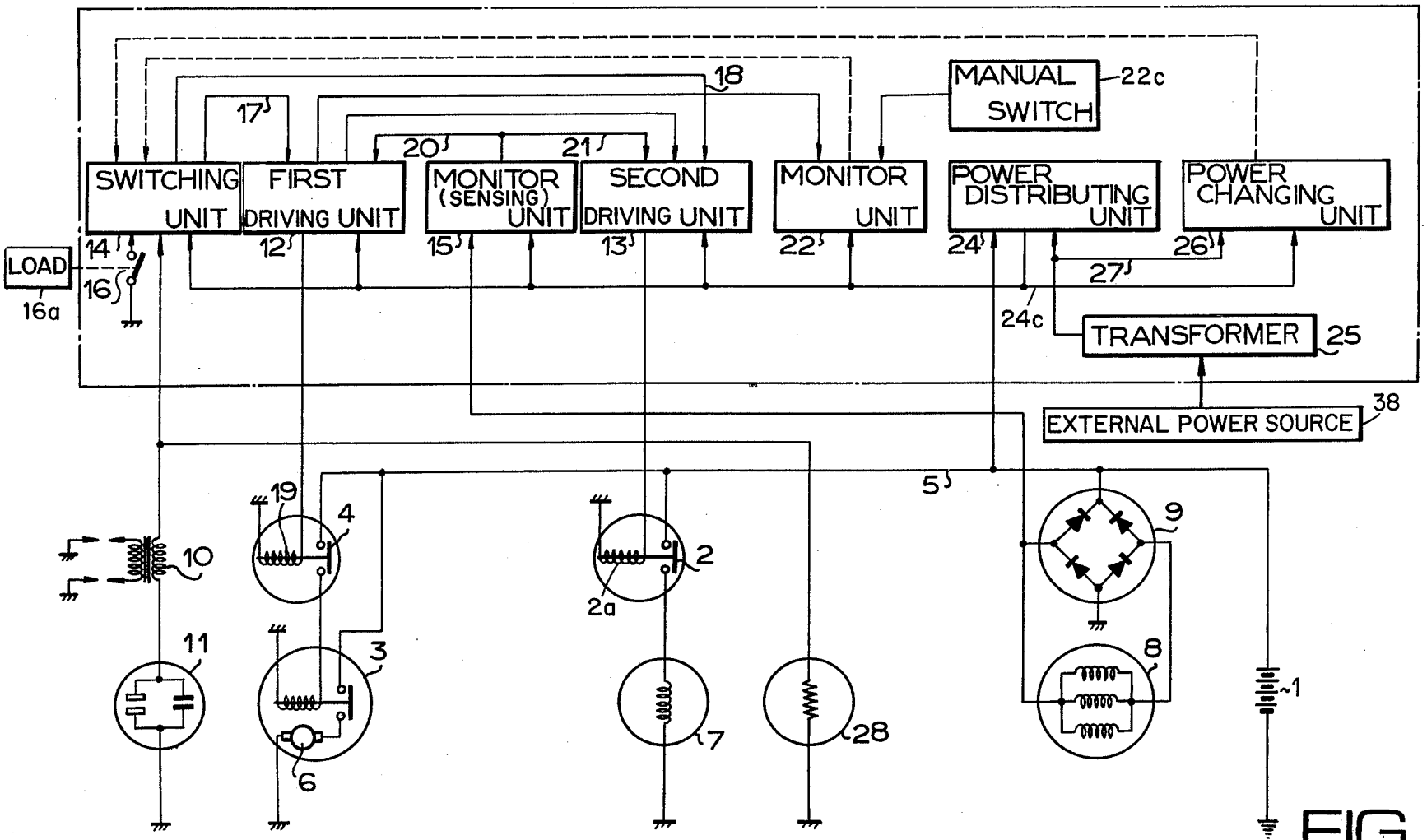
Figure 2:
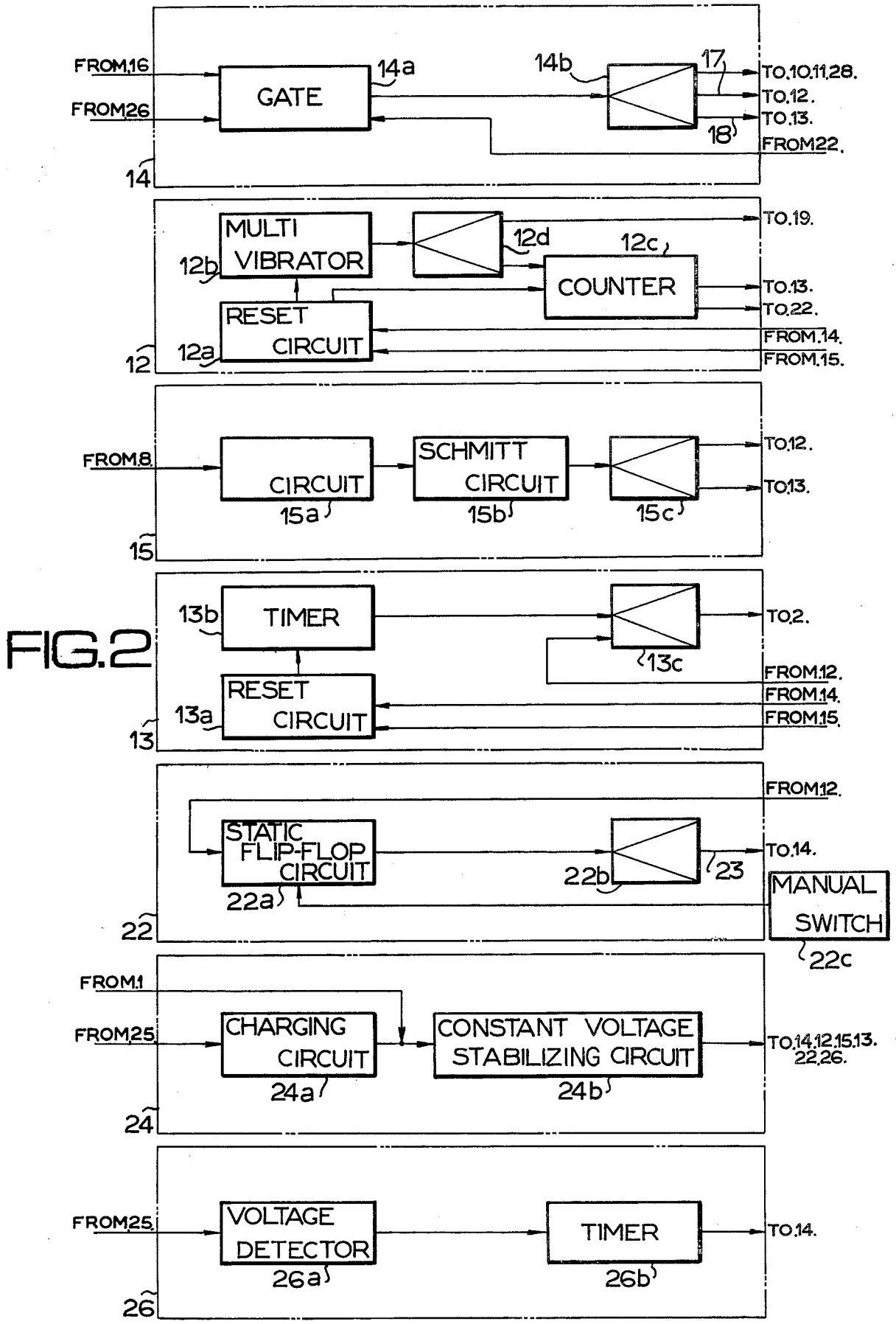

With the above and other objects in view, the present invention including other features and advantages thereof will become more clearly understood from the following description of a preferred embodiment in connecton with the accompanying drawings, in which:

FIG. 1 is a control circuit embodying the present inventions, wherein parts of an engine to be controlled are illustrated together with the system units, and FIG. 2 is an illustration of respective part blocks of the system units.

Referring now to FIG. 1 of the drawings, there is schematically shown a preferred embodiment of an automatic control system according to the present invention for automatically controlling the operation of a gasoline-powered internal combustion engine of a load device 16*a*. A battery 1 has two terminals, one of which is grounded and the other of which is connected to an actuating means such as a relay switch 2 for controlling a throttle valve, of an engine carburetor, and an actuating means such as main relay switch 3 and a sub relay switch 4 for controlling a starter of the engine, all through a line 5. A starter motor 6 is connected to the line 5 via the main relay switch 3, which has a solenoid coil connected to the line 5 via the sub relay switch 4. A solenoid coil 7 is connected to the line 5 via the relay switch 2, and is energized when the switch 2 is closed, whereby the throttle valve provided in the engine carburetor is wholly closed, and enriched air mixture flows through a by-pass provided in the carburetor for initiating the starting of the engine. An alternating current generator 8, which is connected and driven by the engine, is connected to the line 5 through a rectifier 9 as shown in FIG. 1. An ignition coil 10 and an ignition plug 11 are connected to the line 5 through a gate switch included in an automatic control system detailed hereinafter.

The automatic control system is illustrated in dashed lines in FIG. 1, and in general includes a first driving unit 12 of controlling the starter motor 6, a second driving unit 13 for controlling the throttle valve of the carburetor, a switching unit 14 responsive to an input signal supplied from a first sensing means or sensor such as a relay switch 16 connected to the load device 16a and producing operating signals which are supplied to the first and second driving units 12 and 13, and a second sensing means or monitor unit 15.

As shown in FIG. 2 the switching unit 14 comprises a gate 14*a* which is connected to the first sensing means or relay switch 16 to receive the input signal therfrom. The relay switch 16 has a relay coil (not shown) which is energized to close the switch 16, thereby to produce the input signal, in respone to a given operating condition of the load device, for example, when the room temperature of a freezing container included in a refrigerator car reaches a predetermined level. Upon receiving the input signal, the gate 14*a* produces an operating signal which is delivered through an amplifier 14*b* to the ignition coil 10 and to the first and second driving units 12 and 13 via lines 17 and 18.

The first driving unit 12 comprises a reset circuit 12a for receiving the operating signal from the switching unit 14, a non-stable multi-vibrator 12b and a counter 12c consisting of a flip-flop circuit, so as to produce an intermittent output signal which is delivered from the vibrator 12*b* to an amplifier 12d, through which the signal is supplied to a solenoid coil 19 of the sub relay switch 4. The output signal from the amplifier 12d is also supplied to the counter 12*c* which counts the number of the intermittent output signals within prescribed times, for example, three times.

Accordingly, the energizing operation of the solenoid coil 19 is repeated a prescribed number of times until the engine is started by the starter motor 6.

The second driving unit 13 comprises a reset circuit 13*a* for receiving the operating signal from the switching unit 14 and a timer 13*b* having a time lag by which the timer 13*b* continues to supply an output signal through an amplifier 13*c* to the solenoid coil 7 for a prescribed time interval, so that the throttle valve is closed for a predetermined time interval during startng of the engine.

The monitor unit 15 constituting the second sensing means for sensing the engine speed includes a circuit 15*a* for generating a signal having a potential varying in proportion to the frequency of the generator 8 connected to the engine, and a schmitt circuit 15*b* for supplying a speed discriminator signal through an amplifier 15*c* to the reset circuit 12*a* of the first driving unit 12 and the reset circuit 13*a* of the second driving unit 13 (as indicated in FIG. 2) when the voltage of the signal indicative of the engine speed exceeds a prescribed value. The speed discriminator signal is supplied through the amplifier 15*c* to both of the reset circuits 12*a* and 13*a* via lines 20 and 21 (FIG. 1), so that the operating signals are eliminated, thereby causing the solenoid coil 19 and the solenoid coil 12*a* for the switch 2 to be de-energized.

The automatic control system in this embodiment further includes another monitor unit 22 for detecting failure in the starting of the engine, caused by accidents such as a wet-plug and cold air, when the repeated setting operation counts more than the prescribed number of times times, for example, three times determined in the first driving unit 12. The monitor unit 22 comprises a static flip-flop circuit 22*a* to which the output signal is supplied from the counter 12*c* unless the engine is driven by itself within the three times repeating setting operation, and then which supplies an inverted signal through an amplifier 22*b* and a line 23 to the gate 14*a*, so that the gate 14*a* is rendered inoperative, whether or not the input signal is supplied by the relay switch 16, whereby the current for the ignition coil, and the solenoids of the starter and throttle is cut off.

The monitor unit 22 further comprises a manual control switch 22*c* disposed near the driver or monitor so that the closing of the switch 22*c* results in supplying a reset signal to the circuit 22*a* to eliminate the inverted signal from the circuit 22*a* thereby returning the gate 14*a* in an original position.

The automatic control system may further include a power distributing unit 24 which comprises a charging circuit 24*a* with an AC - DC converter, and a constant voltage stabilizing circuit 24*b*, in the case where the battery 1 and an external power source 38, such as a commercially available alternating current source, are alternatively used for performance of the load device.

The external power source 38 is connected to the charging circuit 24*a* through a transformer 25, and the battery 1 may be connected to the interval between the circuits 24*a* and 24*b* so as to distribute the current supply through the unit 24 to the desired units via line 24*c*, and in reverse to be charged when the apparatus is subject to the external source.

In the case where the either the battery of the external electric source is always used, the automatic control system may be provided with an automatic power-charging unit 26 which acts to cut off the operating signals from the first and second driving units when the load device is subject to the external electric source.

Therefore, the power supplied from the external electric source enters a voltage detector 26*a* via a line 27 and is supplied to the gate 14*a* through a timer 26*b*, so that the gate 14*a* is closed by the counter signal from the timer 26*b*. The timer 26*b* has a time lag by which the gate 14*a*, after a prescribed time interval developed from the power stoppage is returned to an original position due to the extinguishing of the counter signal from the timer 26*b*, so that the engine is controlled to the start position.

In this embodiment, there may be provided an electric-heating element 28 for an automatic choke of the engine carburetor which is energized together with the ignition coil 10.

What is claimed is:

1. An automatic control system for a gasoline-powered internal combustion engine for driving a load, the engine having ignition means, a starter motor and a carburetor provided with a throttle valve, comprising in combination:

first sensing means for sensing varying operating conditions of the load and producing an input signal in response to a given operating condition of the load;

second sensing means for sensing engine speed and producing a speed discriminator signal when the engine speed reaches a predetermined value;

first actuating means connected to the starter motor and operable to energize the starter motor for starting the engine;

second actuating means connected to the throttle valve and operable for actuating the throttle valve;

switching means connected at its input to said first sensing means and at its output to the ignition means, said switching means being responsive to said input signal and producing an operating signal in response thereto for energizing the ignition means;

first driving means connected at its input to said switching means and to said second sensing means and at its output to said first actuating means, said first driving means being responsive to said operating signal from said switching means and producing a first output signal in response thereto for energizing said first actuating means thereby to energize the starter motor, and further responsive to said seed discriminator signal for cutting off said first output signal in response thereto for de-energizing said first actuating means thereby to de-energize the starter motor when the engine speed reaches the predetermined value; and second driving means connected at its input to said switching means and at its output to said second actuating means, said second driving means including means for producing a second output signal for a predetermined time, interval in response to said operating signal;

said second actuating means for closing the throttle valve in the presence of said second output signal so that enriched air-fuel mixture is supplied to the engine to initiate the starting of the engine, and for opening the throttle valve to a predetermined opening degree in the absence of said second output signal, so that the engine is allowed to continuously operate to drive the load in the presence of said input signal.

2. An automatic control system according to claim 1, further wherein said second driving means is for cutting off said second output signal in response to said speed discriminator signal.

3. An automatic control system according to claim 1, in which said first driving means includes means for intermittently producing said first output signal for a predetermined number of times to provide a predetermined number of successive periods of energization of said first actuating means until the starting of the engine is initiated, and further comprising monitor means connected to said switching means and responsive to said predetermined number of successive periods of energization of said first actuating means for rendering said switching means inoperative so as to cut off said operating signal.

4. An automatic control system according to claim 2, wherein said second driving means includes a reset means connected to said switching means for receiving said operating signal, said reset means further connected to said second sensing means for receiving said speed discriminator signal, a timer means for providing said second output signal for said predetermined time interval connected to said reset means and operatively connected to said second actuating means, said reset means for actuating said timer means to provide said second actuating signal for said predetermined time interval upon receiving said operating signal and for cutting off said second actuating signal upon receiving said speed discriminator signal.

5. An automatic control system for a gasoline-powered internal combustion engine for driving a load, the engine having an ignition coil, a starter motor and a carburetor provided with a throttle valve, comprising in combination:

electric power distributing means;

first sensing means for sensing varying operating conditions of the load and producing an input signal in response to a given operating condition of the load;

second sensing means for sensing engine speed and producing a speed discriminator signal when the engine speed reaches a predetermined value;

first actuating means connected to the starter motor and operable for energizing the starter motor for effecting the starting of the engine;

second actuating means connected to the throttle valve and operable for actuating the throttle valve;

switching means connected between said electric power distributing means and the ignition coil, said switching means for responding to said input signal and producing an operating signal in response thereto for energizing the ignition coil;

first driving means connected between said electric power distributing means and said first actuating means, said first driving means for responding to said operating signal from said switching means and producing a first ouput signal in response thereto for energizing said first actuating means thereby to energize the starter motor, and further responsive to said speed discriminator signal for cutting off said first output signal in response thereto for de-energizing said first actuating means thereby to de-energize the starter motor when the engine speed reaches the predetermined valve; and second driving means connected between said electric power distributing means and said second actuating means, said second driving means for responding to said operating signal and producing a second output signal for a predetermined time interval;

said second actuating means being responsive to said second output signal for closing the throttle valve for the predetermined time interval so as to cause the carburetor to supply enriched air-fuel mixture to the engine to initiate the starting of the engine, and said second actuating means for de-energizing in the absence of said second input signal for opening the throttle valve to a predetermined opening degree so that the engine is allowed to continuously operate in the presence of said input signal.

6. An automatic control system according to claim 5, in which said electric power distributing means, includes source of electric power, a charging circuit connected to said source of electric power, and a constant voltage stabilizing circuit connected to said charging circuit.

7. An automatic control system according to claim 6, further comprising power changing means operatively connected to said source of electric power for responding to failure occurring in said source of electric power for rendering said switching means inoperative.

8. An automatic control system according to claim 5 further wherein said second driving means is for cutting off said second output signal in response to said speed discriminator signal.

9. An automatic control system according to claim 8, wherein said second driving means includes a reset means connected to said switching means for receiving said operating signal, said reset means further connected to said second sensing means for receiving said speed discriminator signal, a timer means for providing said second output signal for said predetermined time interval connected to said reset means and operatively connected to said second actuating means, said reset means for actuating said timer means to provide said second actuating signal for said predetermined time interval upon receiving said operating signal and for cutting off said second actuating signal upon receiving said speed discriminator signal.

* * * * *

UNITED STATES PATENT AND TRADEMARK OFFICE

CERTIFICATE OF CORRECTION

PATENT NO. : 4 013 056

DATED : March 22, 1977

INVENTOR(S) : Yasuhito Yamaki et al

It is certified that error appears in the above-identified patent and that said Letters Patent are hereby corrected as shown below:

CLAIM 1: Column 4, line 16
after "time" delete the
comma -- , --

CLAIM 6: Column 6, line 9
before "source"
insert -- a --

Signed and Sealed this
Fourteenth Day of June 1977

[SEAL]

*Attest:*

RUTH C. MASON
*Attesting Officer*

C. MARSHALL DANN
*Commissioner of Patents and Trademarks*